US006142559A

United States Patent [19]

Sorel et al.

[11] Patent Number: 6,142,559

[45] Date of Patent: Nov. 7, 2000

[54] SEATING PRODUCT

[75] Inventors: Jess Allen Sorel, Castro Valley; Christopher Lyle Domina; David Eric Simon, both of San Francisco, all of Calif.

[73] Assignee: Steelcase Development Inc., Grand Rapids, Mich.

[21] Appl. No.: 09/197,040

[22] Filed: Nov. 20, 1998

[51] Int. Cl.[7] ..... A47B 83/02

[52] U.S. Cl. ..... 297/135; 297/145; 297/160; 297/161; 297/162; 297/170; 297/173; 297/174; 297/188.2; 297/411.23; 297/411.27; 108/48; 108/49

[58] Field of Search ..... 297/135, 160, 297/161, 162, 170, 173, 145, 188.2, 411.23, 411.26, 411.27, 440.23; 108/42, 49, 152

[56] References Cited

U.S. PATENT DOCUMENTS

| | | | |
|---|---|---|---|
| 1,324,503 | 12/1919 | Hirsch | 297/170 X |
| 1,890,102 | 12/1932 | Urquhart | 297/411.23 |
| 2,184,173 | 12/1939 | Bargen | 297/188.2 X |
| 2,947,348 | 8/1960 | Peckham | 297/145 |
| 3,206,249 | 9/1965 | Gateley | 297/411.23 |
| 3,216,765 | 11/1965 | Junkunc | 297/162 |
| 3,298,735 | 1/1967 | Berman | 297/145 |
| 3,583,760 | 6/1971 | McGregor | 297/145 |
| 3,632,161 | 1/1972 | Arfaras | 297/145 |
| 3,717,375 | 2/1973 | Slobodan | 297/162 |
| 3,913,810 | 10/1975 | Shaw | 297/188.2 X |
| 3,963,272 | 6/1976 | Jones | 297/174 X |
| 4,159,148 | 6/1979 | Schulz | 297/411.27 |
| 4,500,134 | 2/1985 | Kaneko et al. | 297/170 |
| 4,834,449 | 5/1989 | Engelman | 297/145 |
| 4,944,552 | 7/1990 | Harris | 297/162 X |
| 5,050,929 | 9/1991 | Gueringer et al. | 297/145 |
| 5,087,096 | 2/1992 | Yamazaki | 297/162 X |
| 5,129,702 | 7/1992 | Ervin | 108/49 X |
| 5,144,898 | 9/1992 | Posly | 108/48 X |
| 5,547,247 | 8/1996 | Dixon | 297/145 |
| 5,573,301 | 11/1996 | Scott | 297/173 |
| 5,601,331 | 2/1997 | Austin, Jr. et al. | 297/170 |
| 5,606,917 | 3/1997 | Cauffiel | 297/135 X |
| 5,630,642 | 5/1997 | Grimmett et al. | 297/145 |
| 5,683,136 | 11/1997 | Baumann et al. | 297/160 X |
| 5,765,911 | 6/1998 | Sorenson | 297/161 X |
| 5,816,649 | 10/1998 | Shields | 297/161 X |
| 5,848,773 | 12/1998 | Bourassa | 297/135 X |
| 5,899,526 | 5/1999 | LaPointe et al. | 297/173 |
| 5,909,864 | 6/1999 | Wang | 297/173 X |
| 5,927,799 | 7/1999 | Tornero | 297/145 |

OTHER PUBLICATIONS

Busch, Jennifer Thiele, "Think Again", *Contract Design*, Nov., 1998, p. 22, color (2 sheets).

*Primary Examiner*—Peter M. Cuomo
*Assistant Examiner*—Rodney B. White
*Attorney, Agent, or Firm*—Foley & Lardner

[57] ABSTRACT

A seating product is disclosed. The seating product includes a base having a base frame assembly with a pair of side panels. At least one of the side panels has a slot. The seating product also includes a mounting arm having a mounting assembly with a first mounting, bracket adapted to be inserted through the slot in the side panel of the base frame assembly for attachment to the base. An improvement to a seating product with a base and a surface supported by a mounting arm is also disclosed. The improvement includes the base having a base frame assembly with a pair of side panels. The improvement also includes a mounting arm having a mounting assembly with a first mounting bracket adapted to be inserted through a slot in a side panel of the base frame assembly for attachment to the base. The mounting arm may include a worksurface (tablet). The tablet may be coupled for pivotal and/or translating movement with respect to the base. The seating product may be an upholstered chair.

62 Claims, 13 Drawing Sheets

SEATING PRODUCT

CROSS-REFERENCE TO RELATED APPLICATIONS

The following U.S. patent application is cited by reference and incorporated by reference herein: Ser. No. 29/096,841 (Attorney Docket No. 26167-594), titled "SEATING PRODUCT" and filed herewith.

FIELD OF THE INVENTION

The present invention generally relates to a seating product adapted for use within a work environment. More particularly, the present invention relates to a seating product adapted to provide a worksurface (such as a tablet).

BACKGROUND OF THE INVENTION

It is well-known to provide a seating product such as a chair with an arm, or more commonly a pair of arms. It is also known to provide for a seating product such as a chair with a tablet arm having a tablet, for example, of a type configured to provide a worksurface platform or support for materials in use by a person seated in the chair. According to known arrangements, the tablet arm is associated with a mounting assembly installed on one side or the other of the chair. The mounting assembly typically allows for the tablet to be moved to an "in use" position by lifting/translating or pivotal motion. However, according to typical arrangements, in order to accommodate the tablet arm and its associated mounting structure, it becomes necessary to alter the shape or design of the chair itself. As a result, in such known arrangements, it is typically not possible to employ a "modular" design concept wherein the chair may readily be assembled in variations that may or may not include the tablet arm. That is, the decision to provide the capability of including the tablet arm may substantially affect the overall design and assembly of the chair, insofar as interfaces for mounting structures and assemblies for the tablet arm are exposed or conspicuous whether the mounting structures and assemblies and tablet arm are themselves installed or absent. Moreover, in such known arrangements, it is typically not possible to interchange the position of the tablet arm from one side of the chair to the opposite side of the chair (particularly in the case of an upholstered chair).

Accordingly, it would be advantageous to have a seating product such as a chair having a tablet arm with a tablet that can be mounted to the chair and allows for pivoting and/or translating motion of the tablet in a predetermined range. It would also be advantageous to have a seating product such as a chair that includes a tablet arm with a sturdy mounting assembly having a mounting assembly interface that is relatively inconspicuous, whether the tablet arm is installed or absent from the chair. It would further be advantageous to have a seating product such as an upholstered chair that includes a tablet arm that can be removed or installed (on either side of the chair) without generally affecting the overall assembly of the chair in any substantial manner.

SUMMARY OF THE INVENTION

The present invention relates to a seating product. The seating product includes a base having a base frame assembly with a pair of side panels. At least one of the side panels has a slot. The seating product also includes a mounting arm having a mounting assembly with a first mounting bracket adapted to be inserted through the slot in the side panel of the base frame assembly for attachment to the base.

The present invention also relates to an improvement to a seating product with a base and a surface supported by a mounting arm. The improvement includes the base having a base frame assembly with a pair of side panels. The improvement also includes a mounting arm having a mounting assembly with a first mounting bracket adapted to be inserted through a slot in a side panel of the base frame assembly for attachment to the base.

The present invention further relates to a seating product including a base having a slot and a mounting assembly for a mounting arm adapted to be inserted through the slot for attachment to the base.

The present invention further relates to a seating product including a seat, a worksurface adapted to be coupled to the seat and a cam mechanism providing for translating movement of the worksurface relative to the seat.

DETAILED DESCRIPTION OF THE PREFERRED EMBODIMENTS

Figure 1:
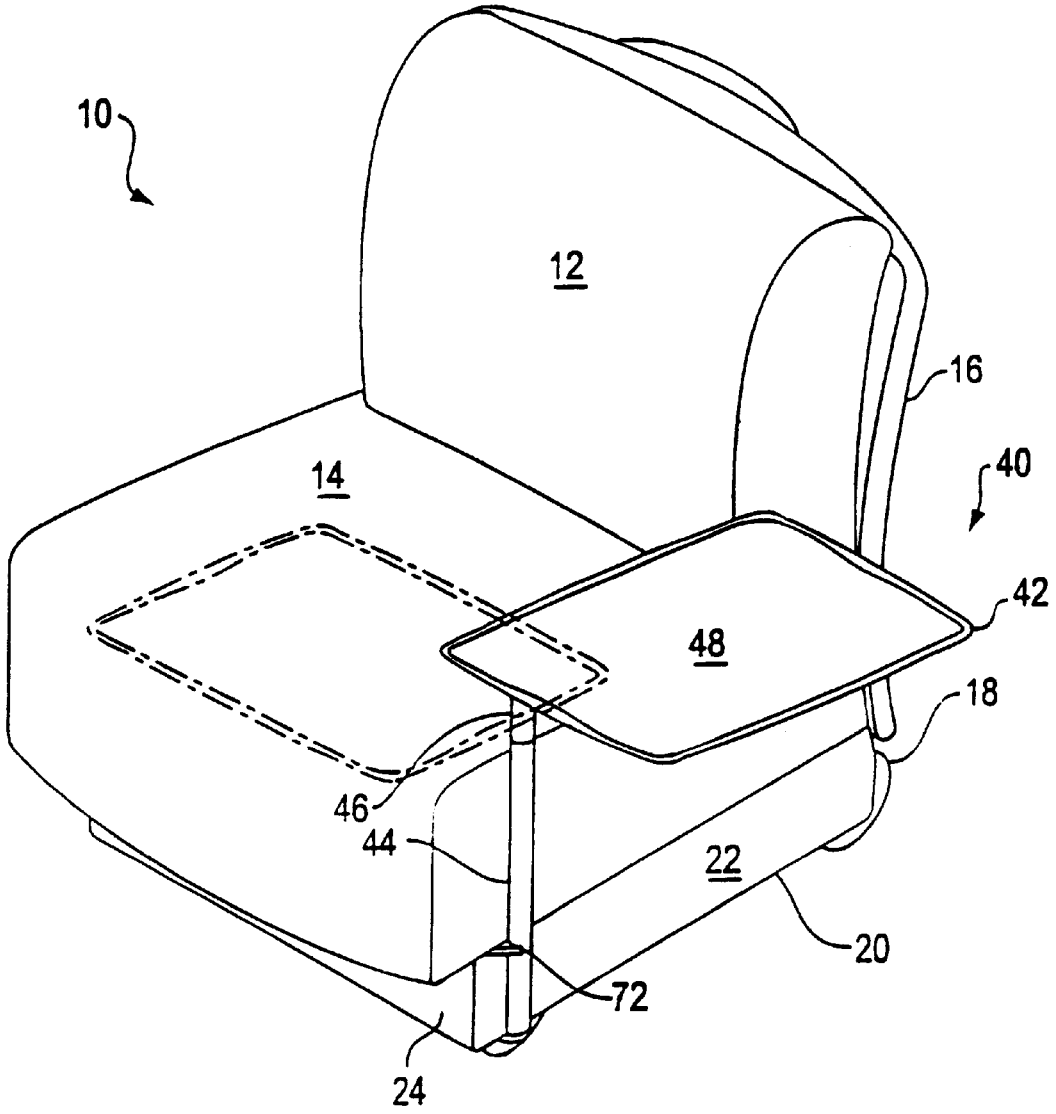
FIG. 1 is a perspective view of a chair according to an exemplary embodiment of the present invention.
Figure 3:
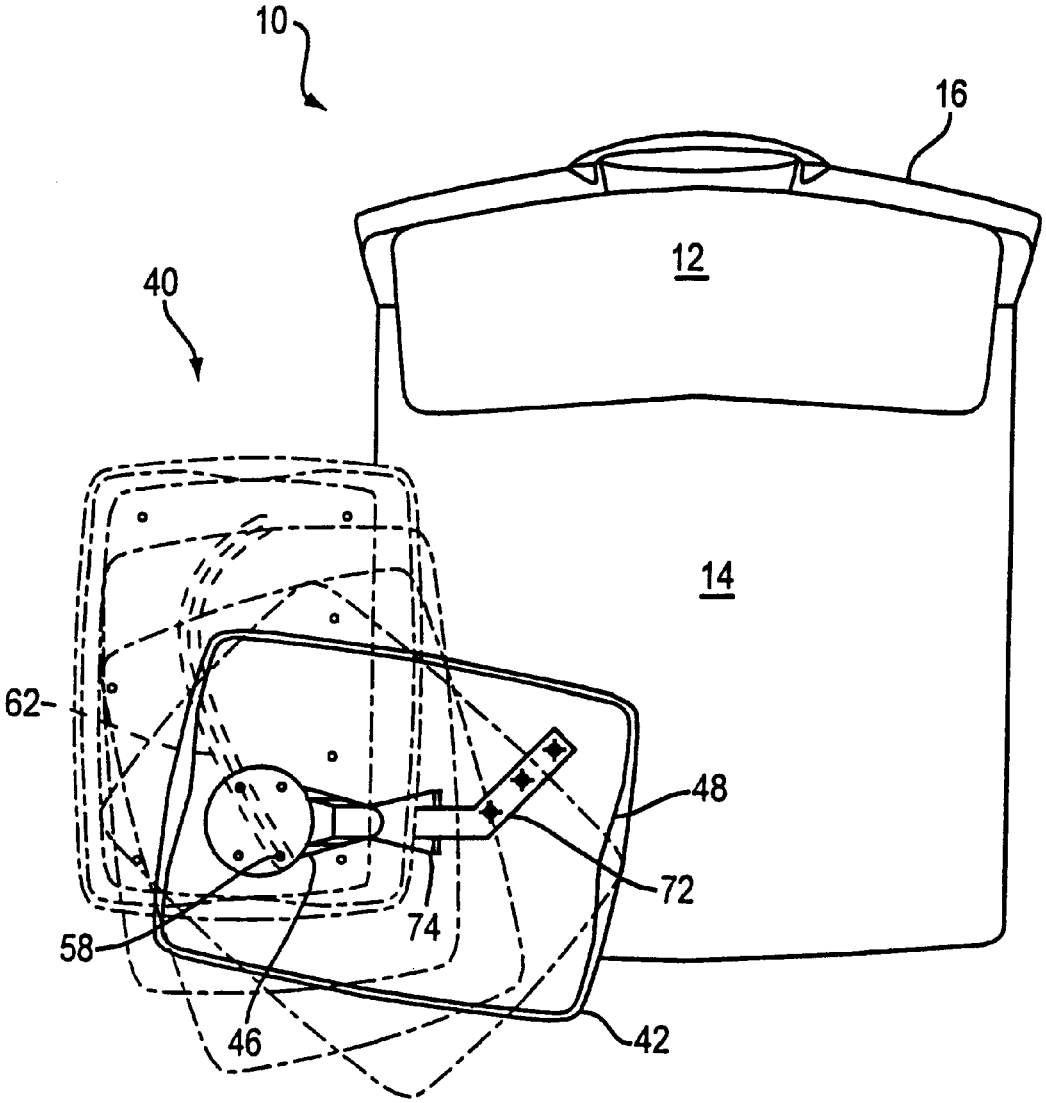
FIG. 3 is a top plan view of a chair according to another exemplary embodiment of the present invention.

In FIG. 1, a seating product shown as a chair 10 includes a mounting assembly shown as a tablet assembly 40 affixed to the left side of chair 10. Chair 10 is illustrated as an upholstered lounge chair having a seat 14, a back 12, a back shell 16, a base 20, and wheels 18 (which may be castered) as well as tablet assembly 40. A worksurface shown as tablet 42 associated with tablet assembly 40 is shown in a "parked" or stowed position allowing entry or egress by an occupant of chair 10, but may be moved to other deployed or "in use" positions with respect to seat 14 within a predetermined range of motion (as shown in FIG. 3). Tablet 42 is supported with respect to base 20 by a mounting arm including a tablet base 46 and a post 44.

Figure 2:
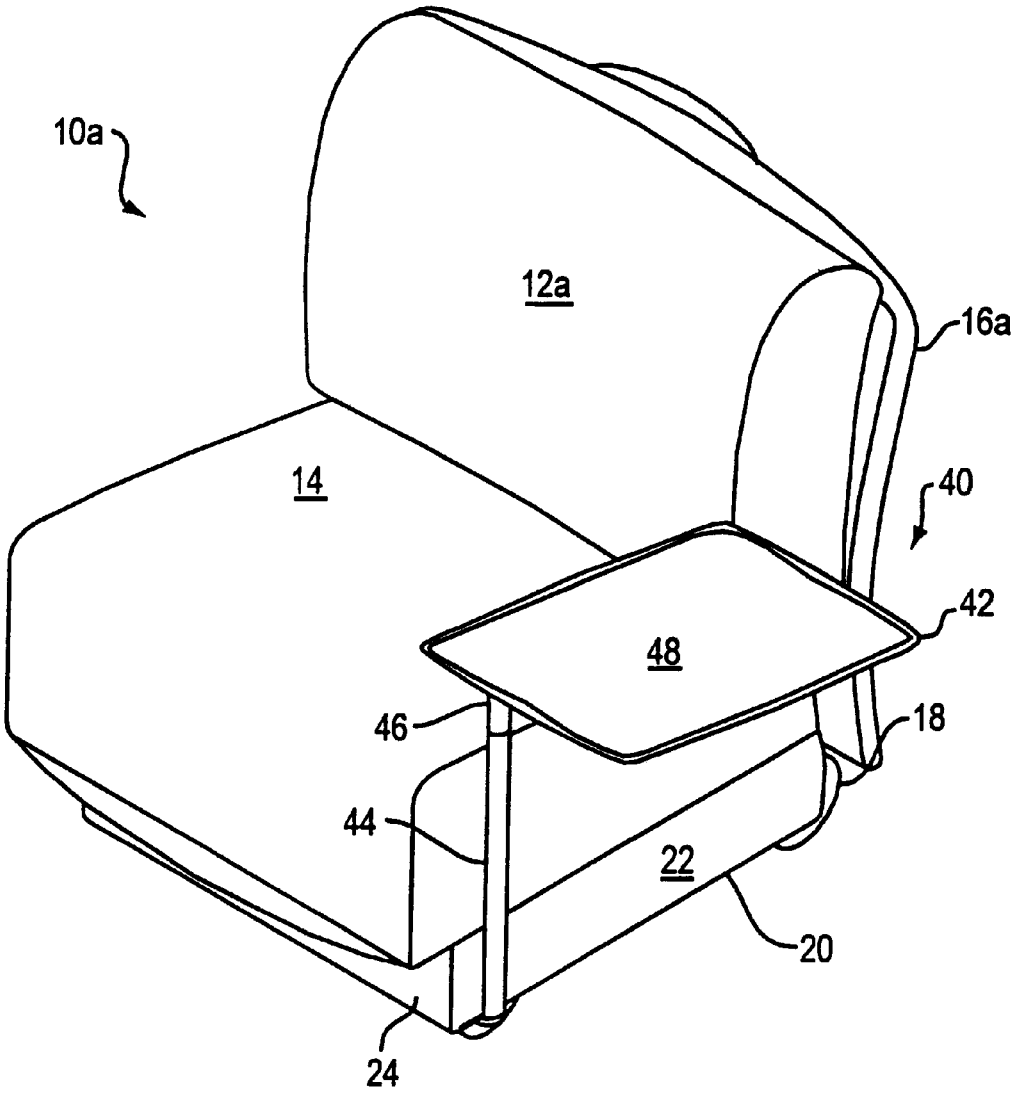
FIG. 2 is a perspective view of a chair according to another exemplary embodiment of the present invention.

FIG. 2 shows another embodiment of a seating product including tablet assembly 40, wherein a chair 10*a* is provided with a wide back 12*a* and a wide back shell 16*a*. Accordingly to other exemplary embodiments, the seating product may be constructed with a relatively large or small width and may, to accommodate space planning constraints, be constructed of width suitable for seating of more than one person, (e.g., as a sofa or a bench.

FIG. 3 shows chair 10 including tablet assembly 40 affixed at the right of base 20. Tablet assembly 40 may be removed from chair 10 when not needed or desired (using tools), or may be affixed to either side of chair 10 (if the mounting arm is interchanged). According to other alternative embodiments, the tablet assembly may be affixed to any area of the base of the seating product that is provided with a suitable mounting interface.

FIG. 3 also shows a path and range of movement of tablet 42 with respect to seat 14 between "parked" and various "in use" position. The position of the tablet may be adjusted within the range to optimize user posture and comfort for a particular activity, as well as to facilitate user egress and entry. Tablet 42 is constrained to the path of motion by the shape or form of a cam 62 (e.g. shown as a cut-out or slot) of a guide plate 60 (e.g. a metal plate) which is affixed to a lower surface of tablet 42 and by shoulder screws 58 supporting bearings 59 (used as cam followers). According to a particularly preferred embodiment illustrated in the FIGURES, the form of cam 62 is in an exemplary curved shape giving a corresponding path of travel of tablet 42 with respect to seat 14 that has been found to be useful for the desired purpose (e.g. without undue extension of the tablet beyond the profile of the chair) and also to give a desirable aesthetic appearance to the chair. According to alternative embodiments, the cam or other mechanism employed may be provided with any variety of shapes or forms (including other curied shapes, linear shapes, split or dual path shapes) that give a desired path of travel for the tablet. Tablet 42 is shown generally configured as a writing surface, but may also be used as a worksurface for other types of work (such as reading or computing) or as a dining surface. According to alternative embodiments, the tablet may have any of a wide variety of sizes, shapes and configurations, suitable for any of a wide variety of activities. According to any preferred embodiment, the path of travel of the tablet (e.g. given by the cam mechanism or other mechanism in the form of translating and/or pivoting movement of the tablet) is coordinated with the size, shape and configuration of the tablet to provide a desired functional and/or aesthetic effect for the chair.

Figure 4:
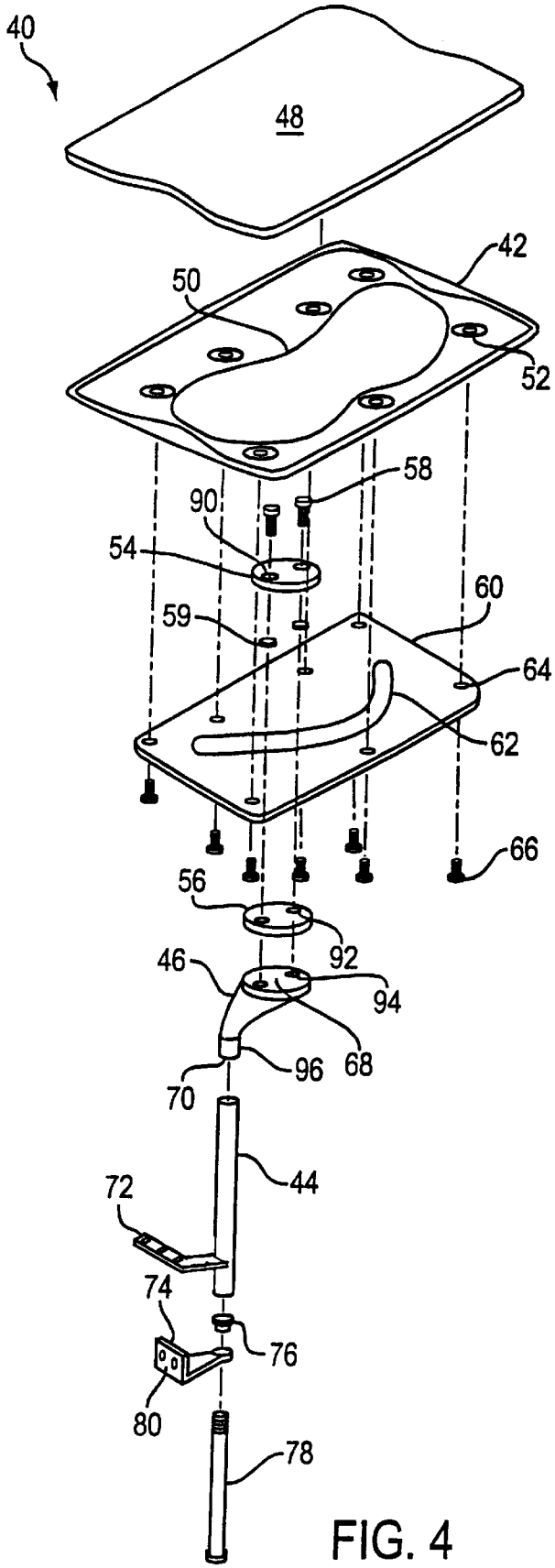
FIG. 4 is a fragmentary exploded perspective view of the tablet assembly shown in FIG. 1.
Figure 11:
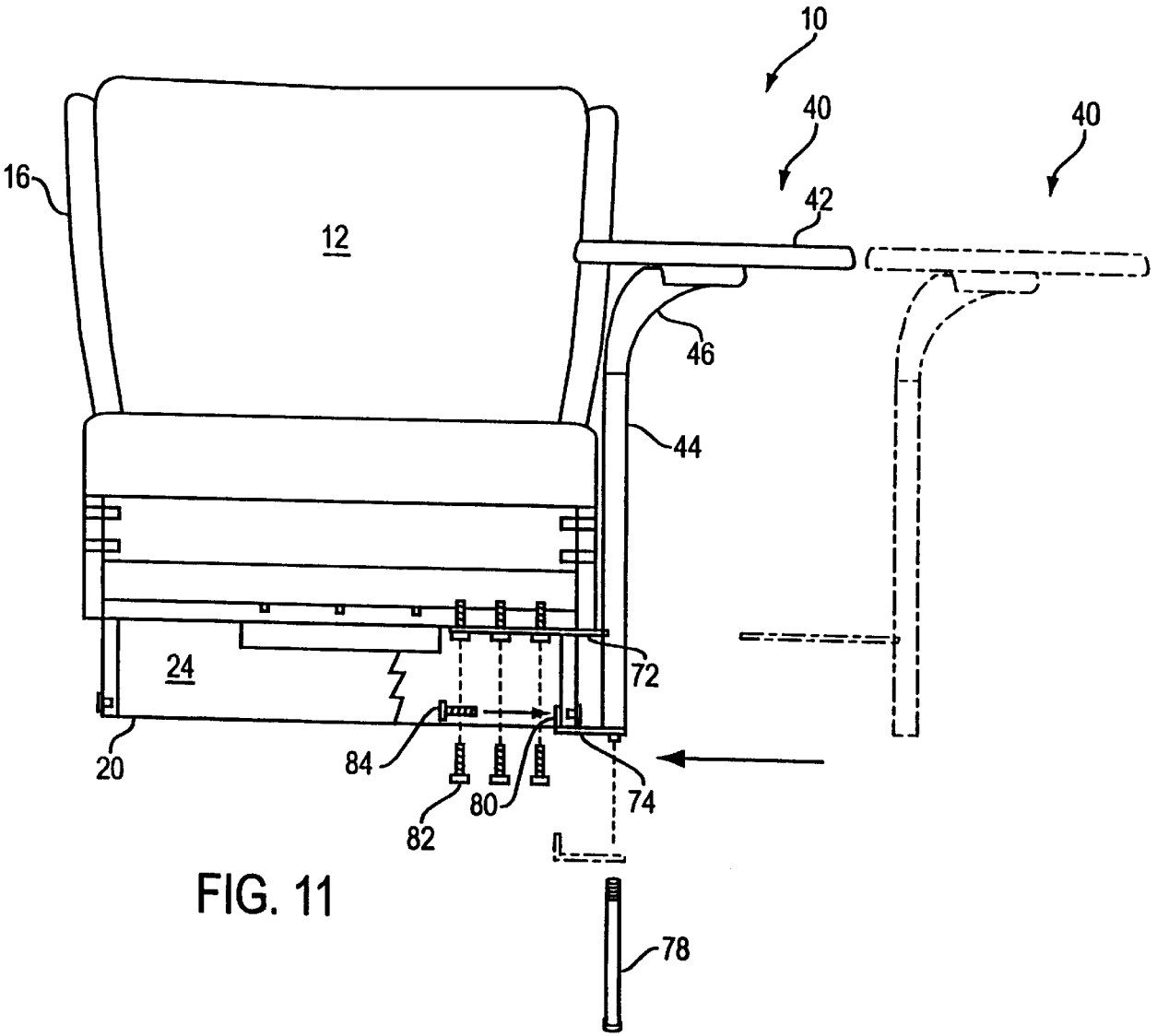
FIG. 11 is an exploded front elevation view of the chair shown in FIG. 1 showing installation of a tablet assembly to the chair.

FIG. 4 shows the general arrangement and construction of a preferred embodiment of tablet assembly 40. Tablet assembly 40 includes a vertically oriented tube shown as a post 44 having affixed to it (e.g., by welding) an upper bracket 72. Upper bracket 72 is adapted to be attached to base 20 of chair 10 (as is shown in FIGS. 11 and 12). Tablet assembly 40 also includes a lower bracket 74 adapted to be attached Lo base 20 (as is shown in FIGS. 11 and 12). Lower bracket 74 is configured to engage and secure post 44 at a bottom end through a bushing 76. A draw bolt 78 is inserted upwardly through post 44 (through apertures in lower bracket 74 and a bushing 76) and engaged with a threaded aperture 70 in the bottom of a tablet base 46. Tablet base 46 includes a projection 96 that engages the inner surface of post 44. Projection 96 includes a tab 45 which engages a slot 47 within the wall of post 44 (at its upper end) to prevent rotation of tablet 42 with respect to post 44. According to alternative embodiments, the tablet assembly may be configured to provide for selective translating and/or pivoting movement of the tablet (e.g. using any conventional mechanism or pivotal coupling).

A tablet arm mounting surface 68 (e.g. frame) is installed at the top of tablet base 46; two threaded apertures 94 extend downwardly from tablet arm mounting surface 68. An tipper follower plate 54 is placed above guide plate 60, with two apertures 90 within upper follower plate 54 aligned with slot or curved form of cam 62 within guide plate 60 (through bearings 59). A lower follower plate 56 is placed below guide plate 60 and upper follower plate 54, with two apertures 90 similarly aligned with cam 62. Cam followers (shown as bearings 59 supported by self-locking shoulder screws 58) are then inserted through apertures 90, through cam 62, and through apertures 92, and screwed into threaded apertures 94 of tablet arm 46. The widths of bearings 59 and the length of the shoulders of shoulder screws 58 are made slightly longer than the total thickness of up[]per cam follower plate 54, guide plate 60 and lower cam follower plate 56, so that guide plate 60 is retained for translating movement with respect to tablet base 46 (along its path of motion).

Tablet 42 is secured to a top surface of guide plate 60 by screws 66, which project upwardly through clearance holes in guide plate 60 to engage threaded holes within a lower surface of tablet 42. Tablet 42 is constructed of a thickness greater than the height of the heads of shoulder screws and is provided a cutout 50 generally following the curved form of cam 62 to provide clearance space for the heads of shoulder screws 58 and upper cam follower plate 54 throughout the path of motion of tablet 42 with respect to seat 14. Tablet 42 is covered by an insert 48 (e.g., secured with an applied hot glue adhesive) to cover cam 62 and cutout 50 and to provide a flat surface upon the top of tablet assembly 40.

Figure 12A:
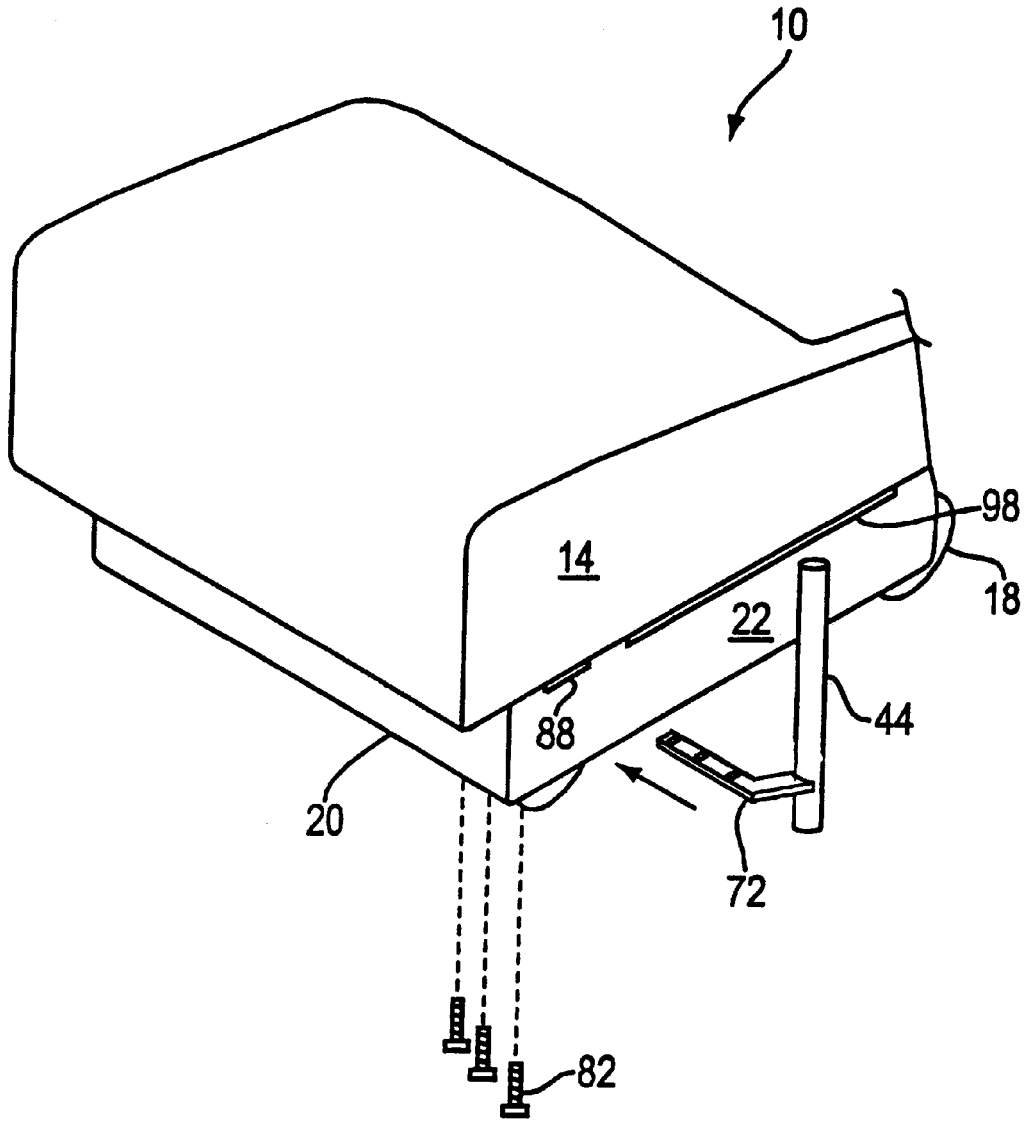
FIG. 12A is an exploded fragmentary perspective view of the chair shown in FIG. 1 showing installation of an upper bracket to the chair.
Figure 12B:
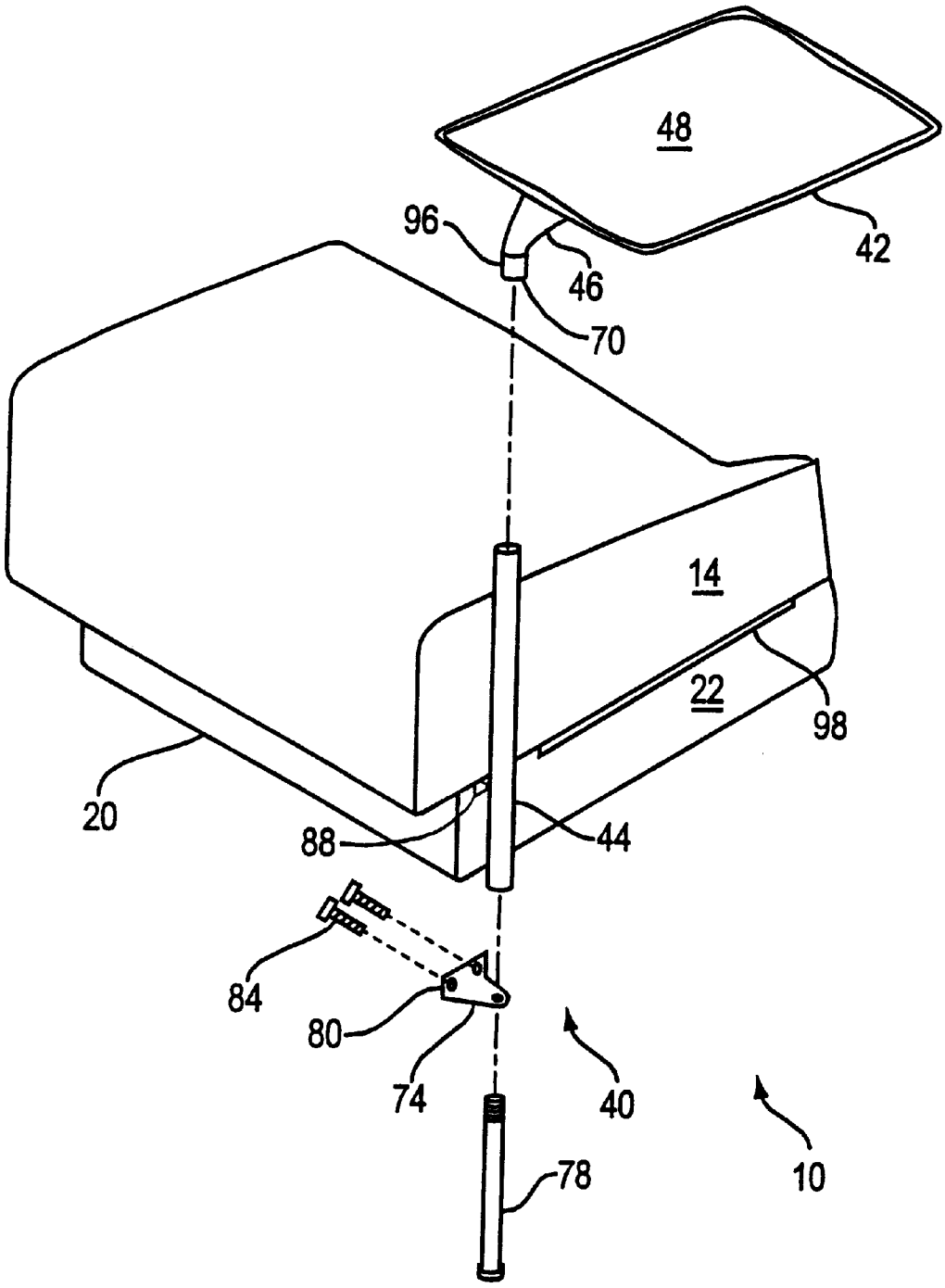
FIG. 12B is an exploded fragmentary perspective view of the chair shown in FIG. 1 showing installation of a lower bracket to the chair.

FIGS. 11, 12A, and 12B show installation of tablet assembly 40 to chair 10. FIG. 11 shows chair 10 with tablet assembly 40 both installed (solid lines) and removed in a position ready for installation (phantom lines). Upper bracket 72 is inserted through slot 88 within base 20 (shown in FIG. 12A); screws 82 (upwardly disposed) have been installed to secure upper bracket 72 to a mounting surface (downwardly facing) of base 20 to attach post 44 of tablet assembly 40 to chair 10. Lower bracket 74 (provided with an upwardly disposed flange 80) has been installed on the bottom end of post 44, so that flange 80 bears upon the inner surface of left side panel 22 of base 20; screws 84 (horizontally disposed) have been installed to secure flange 80 to left side panel 22. Tablet base 46 is then placed over the top end of post 44, and draw bolt 78 inserted upwardly through post 44 and engaged with threaded aperture 70 (within tablet base 46). Tablet arm 46 along with tablet 42 (and related members) is secured to post 44, and post 44 is secured to base 20 of chair 10.

Figure 8:
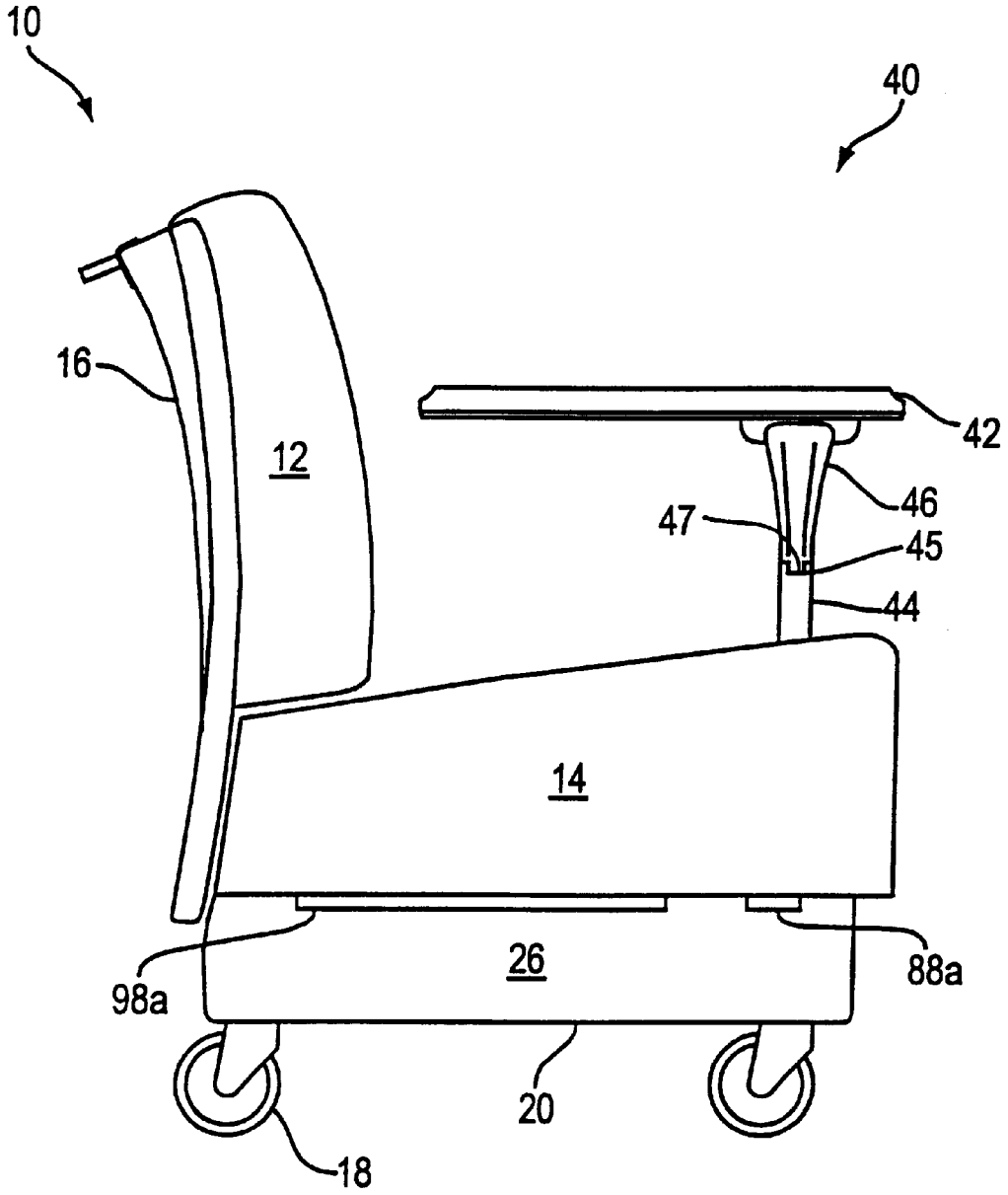
FIG. 8 is a right-side elevation view of the chair shown in FIG. 1.

According to any preferred embodiment, slot 88 provides a relatively compact mounting assembly interface for tablet assembly 40. FIGS. 12A and 12B also show a slot 98 in left side panel 22 (adjacent to slot 88), which may be used for attachment of another accessory to base 20 of chair 10 (e.g., an upholstered arm). According to Can exemplary embodiment (see FIG. 8), similarly configured and positioned slots 88*a* and 98*a* (functioning similarly to slots 88 and 98) are located within right side panel 26 of base 20 of chair 10 for attachment of tablet assembly 40 (or other accessories or elements). It should be noted that the slots are shown schematically in the FIGURES and according to the preferred embodiments may be provided in a position or with dimensions specifically matched for the particular application. It should also be noted that slots 98 or 98*a* may also be used to attach one chair to another (using suitable mounting hardware).

Figure 5:
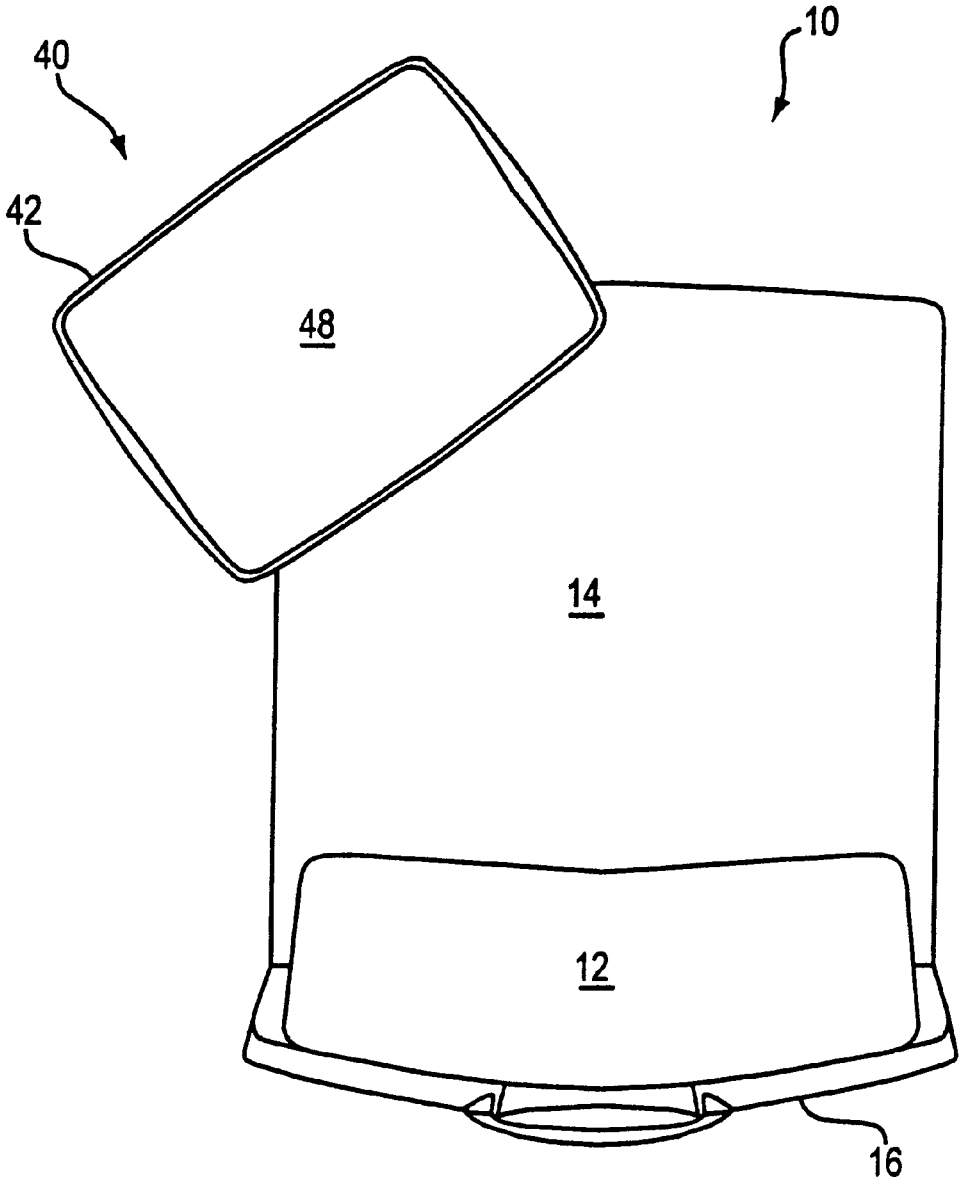
FIG. 5 is a top plan view of the chair shown in FIG. 1.
Figure 6:
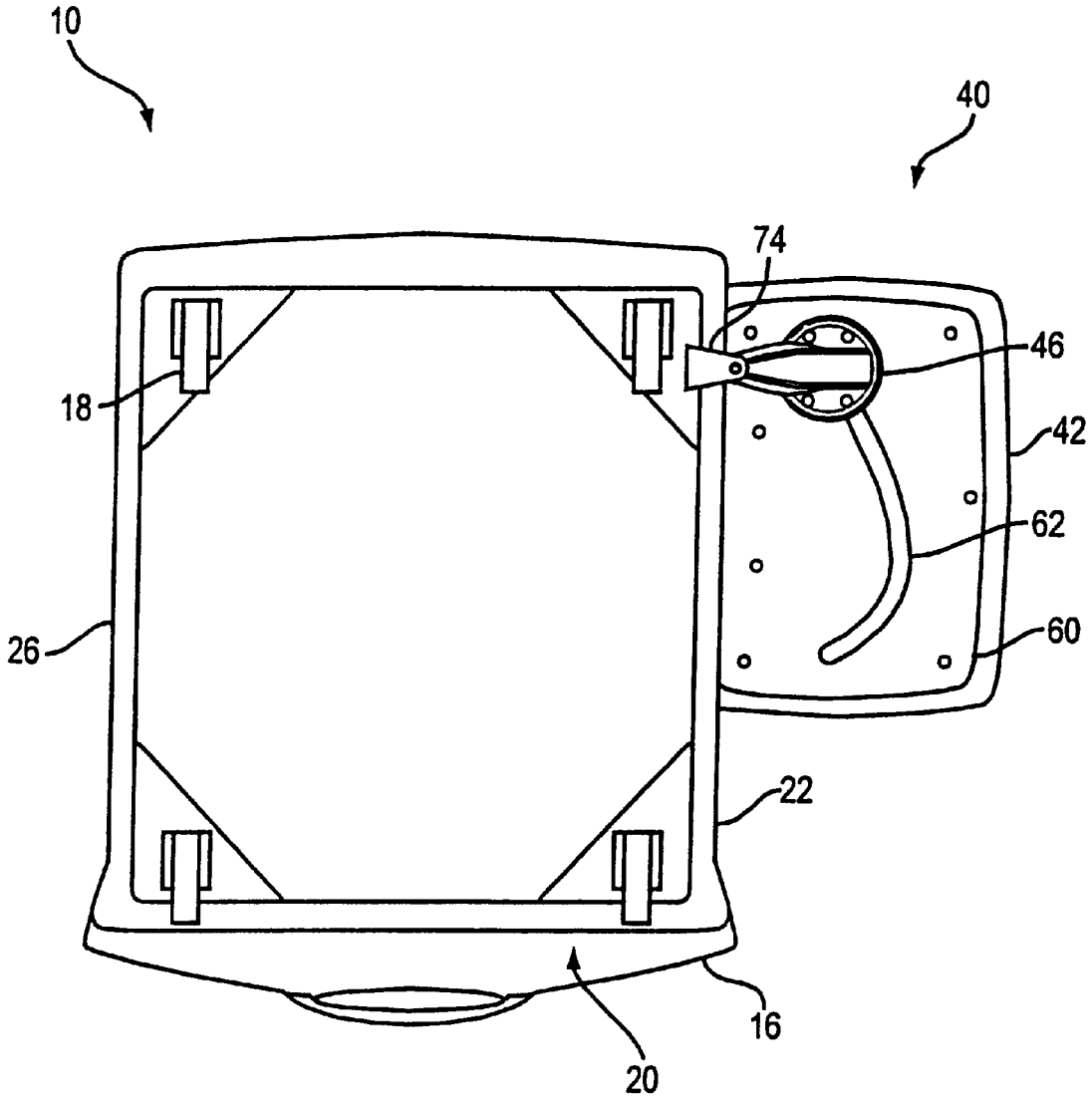
FIG. 6 is a bottom plan view of the chair shown in FIG. 1.
Figure 7:
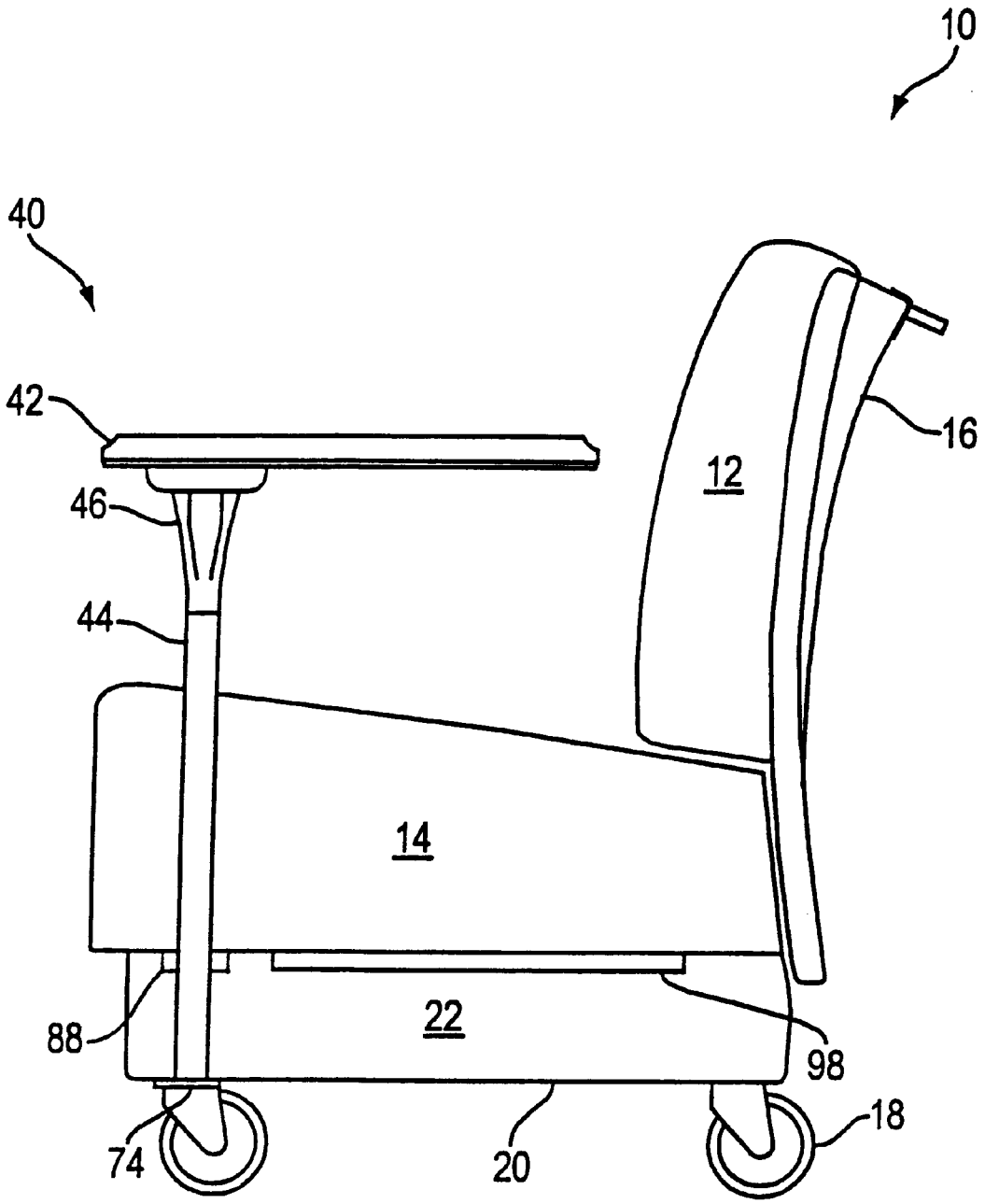
FIG. 7 is a left-side elevation of the chair shown in FIG. 1.
Figure 9:
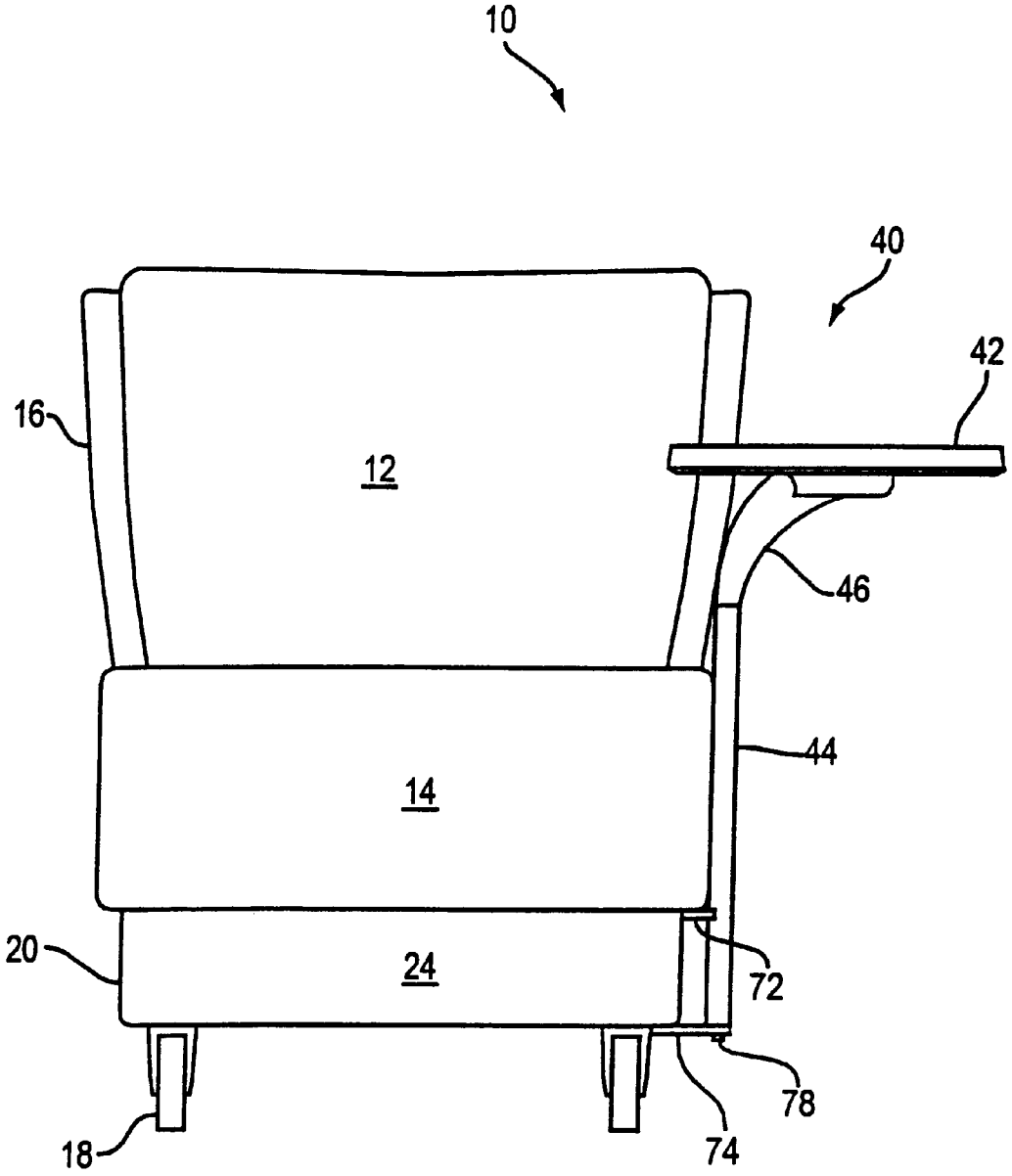
FIG. 9 is a front elevation view of the chair shown in FIG. 1.
Figure 10:
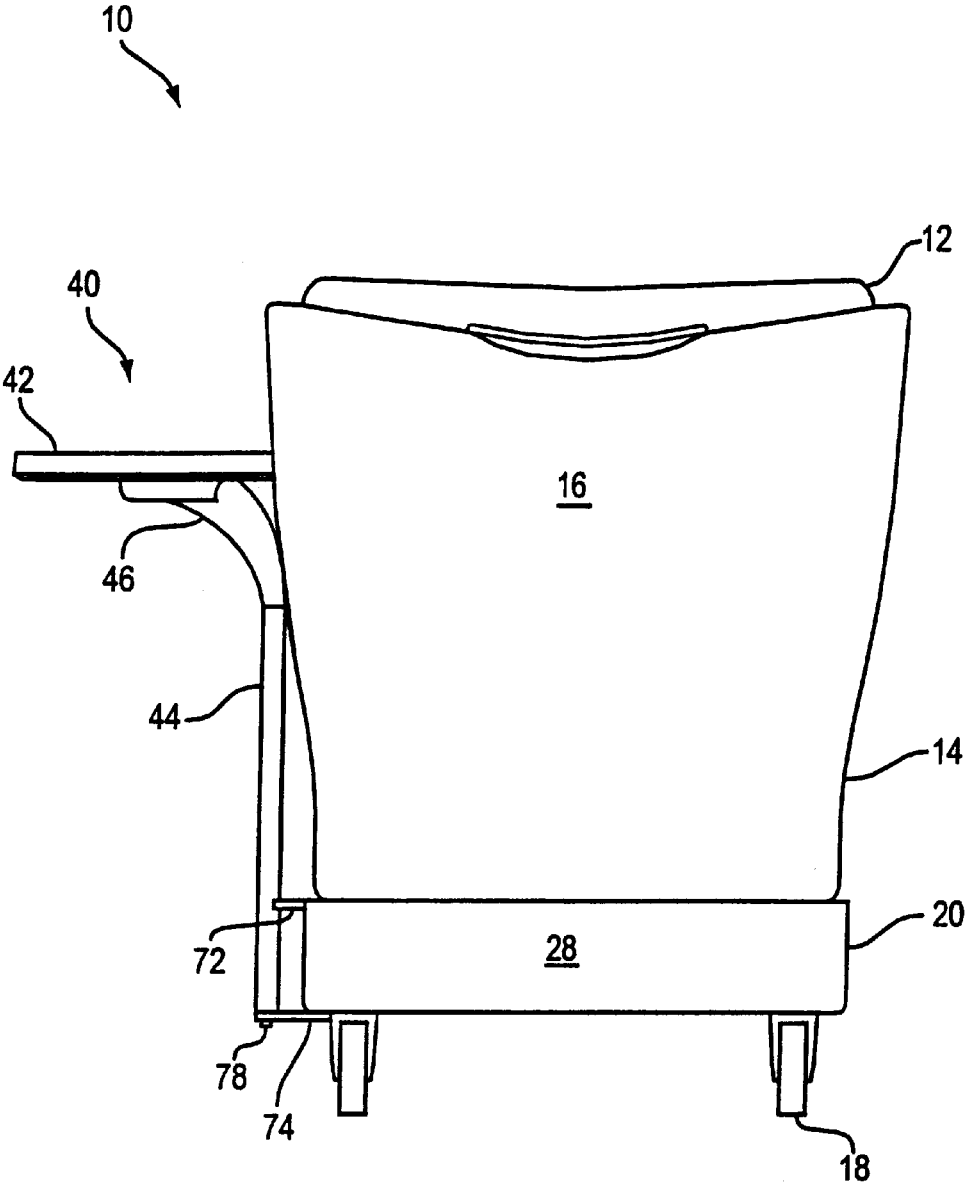
FIG. 10 is a rear elevation view of the chair shown in FIG. 1.

FIG. 5 shows tablet 42 deployed in an "in use" position, extending at least partially over seat 14 of chair 10. FIGS. 6, 7, 8, 9, and 10 show tablet 42 disposed in a "parked" or stowed position. FIG. 6 shows (in a plan view) tablet base 46 engaged with cam 62 of guide plate 60, and the position of securing of lower bracket 74 upon a left side panel 22 of base 20. For installation of tablet assembly 40 upon the other side of chair 10 (with appropriate elements and hardware), lower bracket 74 would be secured to a right side panel 26 of base 20. FIG. 7 shows lower bracket 74 secured to left side panel 22 of base 20 in a side elevation view. FIGS. 9 and 10 show both lower bracket 74 and upper bracket 72 installed to left side panel 22 in front and rear elevation views, respectively.

According to any preferred embodiment the brackets will be of a shape and construction suitable to securely attach the tablet assembly to the seat in the desired position. (As shown, the upper bracket has a slightly angled orientation and is welded to the post.) According to a particularly preferred embodiment, the surface insert of the tablet is made of a veneer/plastic laminate and is mounted into a frame made of cast urethane to form the tablet; the tablet base is a casting.

As is apparent from the FIGURES, according to any preferred embodiment of the present invention, the mounting assembly interface (e.g. slot provided in the base of the seating product and associated elements) is relatively inconspicuous to the overall design of the seating product (whether the tablet arm or surface is installed or absent). Moreover, the mounting assembly may be adapted for installation upon any of a wide variety of seating products.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, mounting arrangements, numbers of fasteners) without materially departing from the novel teachings and advantages of the invention. For example, the mounting assembly for the tablet could be associated with any of a variety of seating products. The tablet may be provided in any of a wide variety of shapes and sizes. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. A seating product comprising:

a base having a base frame assembly with a pair of side panels, at least one of the side panels having an opening;

a mounting arm having a mounting assembly with a first mounting bracket adapted to be inserted through the opening in the side panel of the base frame assembly for attachment to the base and a second mounting bracket coupled to the base.

2. The seating product of claim 1 wherein the second mounting bracket is attached to the base from beneath the base frame assembly.

3. The seating product of claim 2 wherein the first mounting bracket is an upper mounting bracket and the second mounting bracket is a lower mounting bracket.

4. The seating product of claim 1 wherein the base frame assembly includes a generally rectangular base frame that includes the pair of side panels, a front panel and a back panel.

5. The seating product of claim 1 wherein each side panel includes an opening adapted to allow for insertion of the first mounting bracket so that the mounting arm may be mounted to either side panel of the base frame assembly.

6. The seating product of claim 1 wherein the side panel of the base frame assembly further comprises a secondary opening adapted to allow for insertion of a mounting bracket for a secondary arm.

7. The seating product of claim 6 wherein an upholstered seat is mounted upon the base and the secondary arm is an upholstered arm.

8. The seating product of claim 1 wherein a seat and a back are mounted upon the base.

9. The seating product of claim 8 wherein the seat is upholstered.

10. The seating product of claim 1 further comprising a tablet coupled to the mounting arm for rotational movement with respect to the base.

11. The seating product of claim 1 further comprising a tablet coupled to the mounting arm for translational movement with respect to the base.

12. The seating product of claim 1 wherein the base further comprises a plurality of casters adapted to allow for movement of the seating product along a surface.

13. The seating product of claim 1 wherein the first mounting bracket is cantilevered from the mounting arm.

14. A seating product comprising:

a base having a base frame assembly with a pair of side panels, at least one of the side panels having a slot;

a mounting arm having a mounting assembly with a first mounting bracket adapted to be inserted through the slot in the side panel of the base frame assembly for attachment to the base and a second mounting bracket attached to the base from beneath the base assembly:

wherein the first mounting bracket is an upper mounting bracket and the second mounting bracket is a lower mounting bracket; and wherein the base has an upper frame assembly upon a base frame assembly so that the upper mounting bracket is secured to the upper frame assembly and the lower mounting bracket is secured to the base frame assembly.

15. The seating product of claim 14 wherein the lower mounting bracket is secured to at least one of the side panels of the base frame assembly.

16. The seating product of claim 14 further comprising a surface coupled to the mounting arm wherein the second mounting bracket is adapted to allow for pivotal rotation of the surface with respect to the base.

17. In a seating product having a base and a surface supported by a mounting arm, an improvement comprising: the base having a base frame assembly with a pair of side panels and the mounting arm having a mounting assembly with a first mounting bracket adapted to be inserted through a slot in a side panel of the base frame assembly for fixed attachment to the base wherein the first mounting bracket is substantially concealed from view when inserted in the slot, the mounting assembly including a second mounting bracket attached to the base from beneath the base frame assembly.

18. The seating product of claim 1 wherein the opening is a slot.

19. The seating product of claim 18 wherein the lower mounting bracket is adapted for attachment to the base from beneath the base frame assembly.

20. The seating product of claim 1 wherein the first mounting bracket is a first plate and the second mounting bracket is a second plate.

21. The seating product of claim 17 further comprising a seat and a worksurface coupled to the mounting arm for curvilinear movement along a path of travel in a generally horizontal plane between a first position and a second position relative to the seat and wherein the slot is an opening located on at least one side of at least one of the pair of side panels and also wherein the first mounting bracket provides a generally horizontal member.

22. The seating product of claim 17 wherein the mounting arm is oriented in a generally vertical position.

23. The seating product of claim 17 wherein the surface is a tablet and the mounting arm is a tablet arm.

24. The seating product of claim 23 wherein the tablet is coupled to the tablet arm for rotational movement.

25. The seating product of claim 23 wherein the tablet is coupled to the tablet arm for translational movement.

26. The seating product of claim 17 wherein the base frame assembly includes a generally rectangular base frame that includes the pair of side panels, a front panel and a back panel.

27. The seating product of claim 17 wherein each side panel includes a slot adapted to allow for insertion of the first mounting bracket so that the mounting arm may be mounted to either side panel of the base frame assembly.

28. The seating product of claim 17 wherein the side panel of the base frame assembly further comprises a secondary slot adapted to allow for insertion of a mounting bracket for a secondary arm.

29. The seating product of claim 28 wherein an upholstered seat is mounted upon the base and the secondary arm is an upholstered arm.

30. The seating product of claim 17 wherein a seat and a back are mounted upon the base.

31. The seating product of claim 30 wherein the seat is upholstered.

32. The seating product of claim 17 wherein the base further comprises a plurality of casters adapted to allow for movement of the seating product along a surface.

33. The seating product of claim 17 wherein the first mounting bracket is cantilevered from the mounting arm.

34. The seating product of claim 17 wherein the first mounting bracket is an upper mounting bracket and the second mounting bracket is a lower mounting bracket.

35. In a seating product having a base and a surface supported by a mounting arm, an improvement comprising:

the base having a base frame assembly with a pair of side panels and the mounting arm having a mounting assembly with a first mounting bracket adapted to be inserted through a slot in a side panel of the base frame assembly for attachment to the base and a second mounting bracket attached to the base from beneath the base frame assembly and the first mounting bracket is an upper mounting bracket and the second mounting bracket is a lower mounting bracket;

wherein the base has an upper frame assembly upon a base frame assembly so that the upper mounting bracket is secured to the upper frame assembly and the lower mounting bracket is secured to the base frame assembly.

36. The seating product of claim 35 wherein the lower mounting bracket is secured to a side panel of the base frame assembly.

37. The seating product of claim 35 wherein the lower mounting bracket is adapted to allow for pivotal rotation of the surface with respect to the base.

38. A seating product comprising:

a base having an opening;

a mounting assembly for a mounting arm adapted to be inserted through the opening for attachment to the base;

wherein the mounting assembly includes a first mounting bracket adapted to be inserted through the opening and a second mounting bracket mounted to the base.

39. The seating product of claim 38 wherein the second mounting bracket is adapted to be attached beneath the base.

40. The seating product of claim 39 wherein the base includes a pair of side panels, each side panel including an opening adapted to allow for insertion of the first mounting bracket so that the mounting arm may be mounted to either side panel.

41. The seating product of claim 38 wherein the base includes a secondary opening adapted to allow for insertion of a mounting bracket for a secondary arm.

42. The seating product of claim 38 wherein an upholstered seat is mounted upon the base and the secondary arm is an upholstered arm.

43. The seating product of claim 38 wherein a seat and a back are mounted upon the base.

44. The seating product of claim 38 wherein the seat is upholstered.

45. The seating product of claim 38 further comprising a surface coupled to the mounting arm for rotational movement.

46. The seating product of claim 38 further comprising a surface coupled to the mounting arm for translational movement.

47. The seating product of claim 38 wherein the mounting assembly includes a post.

48. The seating product of claim 47 wherein the mounting assembly include a mounting base installed upon the post.

49. The seating product of claim 48 wherein a worksurface is coupled to the mounting base for translational movement with respect to the mounting base within a predetermined range of motion.

50. A seating product comprising:

a base having a first base assembly, a second base assembly, and having at least one side panel having a slot;

a seat mounted on the first assembly of the base;

a back mounted on the first assembly of the base;

a worksurface adapted to be coupled to the seat to allow a path of travel between a first position and a second position;

a cam mechanism providing for translational movement of the worksurface relative to the seat and including a non-linear cam guide.

51. The seating product of claim 50 wherein the cam guide has a curved shape.

52. The seating product of claim 51 further comprising at least one follower configured to engage the cam guide.

53. The seating product of claim 50 wherein the cam guide has a curved shape of a non-constant radius.

54. The seating product of claim 50 wherein the worksurface is in a transverse orientation with respect to the seat at the first position along the path of travel and in a parallel orientation with respect to the seat at the second position along the path of travel, the path of travel corresponding at least partially to a shape of the cam guide.

55. The seating product of claim 54 wherein the worksurface is selectively positionable along a path of travel between the first position and the second position.

56. The seating product of claim 55 wherein the work-surface is generally rectangular shaped.

57. The seating product of claim 56 wherein the cam guide is provided by a guide plate and a cutout is provided by a cover plate and the guide plate is configured for attachment to the cover plate.

58. The seating product of claim 57 further comprising a generally continuous and planar cap attached to the cover plate.

59. The seating product of claim 50 wherein the cam guide has a radius that varies in length along a path of travel relative to the seat.

60. The seating product of claim 50 wherein the work-surface is configured for translational movement relative to the seat along a non-linear path.

61. The seating product of claim 50 wherein the work-surface is indirectly coupled to the seat.

62. The seating product of claim 50 wherein the first position is a generally transverse position relative to the seat and the second position is a generally angular position relative to the seat.

* * * * *